United States Patent [19]

Sugimoto et al.

[11] Patent Number: 4,581,329

[45] Date of Patent: Apr. 8, 1986

[54] SILVER HALIDE PHOTOGRAPHIC LIGHT-SENSITIVE MATERIAL

[75] Inventors: Tadao Sugimoto; Sumito Yamada; Hideo Ikeda; Masaki Okazaki; Tadashi Ikeda, all of Kanagawa, Japan

[73] Assignee: Fuji Photo Film Co., Ltd., Kanagawa, Japan

[21] Appl. No.: 588,410

[22] Filed: Mar. 12, 1984

[30] Foreign Application Priority Data

Mar. 11, 1983 [JP] Japan ..... 58-40249

[51] Int. Cl.[4] ..... G03C 1/02

[52] U.S. Cl. ..... 430/567; 430/569; 430/591; 430/592

[58] Field of Search ..... 430/591, 592, 595, 567, 430/569

[56] References Cited

U.S. PATENT DOCUMENTS

| | | | |
|---|---|---|---|
| 2,945,763 | 7/1960 | Jones | 430/588 |
| 3,615,635 | 10/1971 | Shiba et al. | 430/576 |
| 3,617,294 | 11/1971 | Shiba et al. | 430/591 |
| 3,672,898 | 6/1972 | Schwan et al. | 430/507 |
| 3,788,859 | 1/1974 | Nakazawa et al. | 430/592 |
| 4,152,163 | 5/1979 | Sato et al. | 430/574 |
| 4,439,520 | 3/1984 | Kofron et al. | 430/569 |

*Primary Examiner*—Mary F. Downey

*Attorney, Agent, or Firm*—Sughrue, Mion, Zinn, Macpeak and Seas

[57] ABSTRACT

A silver halide photographic light-sensitive material which comprises a support, a hydrophilic colloid layer or layers and a silver halide emulsion layer or layers, wherein at least one of said silver halide emulsion layers contains tabular silver halide grains having a diameter:-thickness ratio of 5:1 or more and at least one compound represented by the following general formula (I) or general formula (II):

(I)

(II)

wherein $Z_1$ represents the non-metal atoms necessary to complete a 5- or 6-membered heterocyclic ring; $R_1$ represents an unsubstituted or substituted alkyl group; $R_2$ represents an unsubstituted or substituted aryl group with up to 2 aromatic fused rings, or an unsubstituted or substituted aralkyl group; $R_3$ represents a hydrogen atom or with $R_1$ an alkylene group forming a ring; $R_4$ represents a hydrogen atom, an unsubstituted or substituted lower alkyl group, an unsubstituted or substituted aryl group, or an unsubstituted or substituted aralkyl group; n represents 0 or 1, with n being 0 when an inner salt is formed; and X represents an acid anion.

15 Claims, No Drawings

SILVER HALIDE PHOTOGRAPHIC LIGHT-SENSITIVE MATERIAL

FIELD OF THE INVENTION

This invention relates to a silver halide photographic light-sensitive material and, more particularly, to a silver halide photographic light-sensitive material containing tabular silver halide grains.

BACKGROUND OF THE INVENTION

Various techniques have been considered in the field of silver halide photographic light-sensitive materials to improve the covering power of silver halide from the standpoint of conserving silver. Use of tabular silver halide grains is one of these techniques.

The technique of using tabular silver halide grains is excellent with respect to improving the covering power and also has advantages in that the light-receiving area, etc., can be made larger. However, light-sensitive materials using tabular silver halide grains have disadvantages because they are susceptible to changes in development processing conditions and easily fog in high-temperature accelerated processing. Therefore, this technique is not satisfactory for an emulsion having high sensitivity and sufficiently low fog.

Hitherto, it is known to incorporate various additives, such as stabilizers and antifoggants, in ordinary silver halide photographic light-sensitive materials for the purpose of minimizing their dependence on development processing conditions. For example, nitrobenzimidazoles, mercaptothiazoles, benzotriazoles, nitrobenzotriazoles, mercaptotetrazoles, etc., are described as such additives in U.S. Pat. Nos. 3,954,474 and 3,982,947, Japanese Patent Publication No. 28660/77, etc. However, while these additives can depress an increase in fog of a silver halide photographic light-sensitive material containing tabular grains during high-temperature processing to some extent, but a remarkable decrease in sensitivity cannot be prevented.

For example, high-temperature development for efficiently conducting development, particularly, high-temperature accelerated development processing, using an automatic developing machine, is known and is employed in processing of various light-sensitive materials with good results. However, since light-sensitive materials are to be processed at elevated temperatures in this type development processing, photographic emulsion films must be prevented from becoming physically fragile during the processing due to pressure applied thereto by rollers and belts of the automatic developing machine. Therefore, techniques must be worked out to enhance the physical strength of emulsion films during their development in a developing solution so that their physical strength is maintained. For this purpose, one technique involves conducting the processing with an aldehyde hardener to a developing solution. This technique serves to shorten the entire processing time due to the high-temperature processing, and an acceleration of the processing can be attained to some extent. However, development processing with a developing solution containing, for example, an aldehyde, particularly an aliphatic dialdehyde, concurrently causes serious fog formation. This tendency becomes more serious as the temperature of the developing solution increases and as the processing time becomes larger. The fog which occurs with aldehydes can be depressed to some extent by using strong antifogging agents such as benzotriazole and 1-phenyl-5-mercaptotetrazole (as described in L. F. A. Mason, *Photographic Processing Chemistry*, p. 40, The Forcal Press (1975)). However, these antifogging agents concurrently depress development to a strong extent. Thus, emulsion sensitivity is seriously reduced.

On the other hand, it is known that fog can be depressed effectively by the addition of a dye. For example, U.S. Pat. No. 2,131,038 shows that the alkyl quaternary salt of oxazole, selenazole or thiazole which forms the mother nucleus of the dye depresses fog during high-temperature processing, and U.S. Pat. No. 3,930,860 shows that fog during high-temperature color development can be depressed effectively by the use of a particular dye.

Also, Japanese Patent Application (OPI) No. 61519/79 (the term "OPI" as used herein refers to a "published unexamined Japanese patent application") discloses a method for high-temperature development processing using a novel merocyanine dye in combination with high spectral sensitization, and U.S. Pat. No. 4,232,118 discloses a method providing a stable photographic property which causes little fog even in high-temperature processing by using such together with monomethincyanine dye. Moreover, *Research Disclosure*, January 1983, No. 22534 discloses the use of a particular hemicyanine dye. However, these methods do not provide a satisfactory fog depressing effect when they are employed with tabular silver halide grains having a diameter 5 times or more of their thickness.

SUMMARY OF THE INVENTION

Accordingly, an object of this invention is to provide a silver halide photographic light-sensitive material where fog is depressed effectively enough to provide satisfactory high-temperature accelerated processing and also which contains highly sensitive tabular silver halide grains.

As a result of various investigations, it has now been found that the above-described object is effectively attained by the following silver halide photographic light-sensitive material.

That is, the present invention provides a silver halide photographic light-sensitive material comprising a support, a hydrophilic colloid layer or layers and a silver halide emulsion layer or layers, wherein at least one of the silver halide emulsion layers contains tabular silver halide grains having a diameter to thickness ratio of 5:1 or more and at least one of the compounds represented by the following general formula (I) and general formula (II):

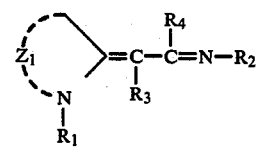

(I)

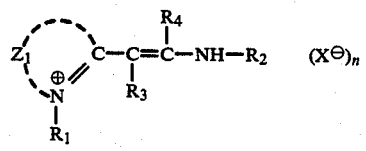

(II)

wherein $Z_1$ represents the non-metal atoms necessary to complete a 5- or 6-membered heterocyclic ring, $R_1$ represents an unsubstituted alkyl group or a substituted alkyl group, $R_2$ represents an unsubstituted or substituted aryl group containing up to 2 aromatic fused nuclei, or an unsubstituted or substituted aralkyl group, $R_3$ represents a hydrogen atom or an alkylene group necessary to complete a ring upon combination with $R_1$, $R_4$ represents a hydrogen atom, an unsubstituted or substituted lower alkyl group, an unsubstituted or substituted aryl group, or an unsubstituted or substituted aralkyl group, n represents 0 or 1, with n being 0 when an internal salt is formed, and X represents an acid anion.

DETAILED DESCRIPTION OF THE INVENTION

Specific examples of heterocyclic ring nuclei completed by $Z_1$ are as follows: a thiazole nucleus (e.g., thiazole, 4-methylthiazole, 4-phenylthiazole, 4,5-dimethylthiazole, 4,5-dipheylthiazole, etc.), a benzothiazole nucleus (e.g., benzothiazole, 5-chlorobenzothiazole, 5-methylbenzothiazole, 6-methylbenzothiazole, 5,6-dimethylbenzothiazole, 5-bromobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-hydroxybenzothiazole, 5-hydroxy-6-methylbenzothiazole, tetrahydrobenzothiazole, etc.), a naphthothiazole nucleus (e.g., naphtho[2,1-d]thiazole, naphtho[1,2-d]thiazole, naphtho[2,3-d]thiazole, etc.), a thiazoline nucleus (e.g., thiazoline, 4-methylthiazoline, etc.), an oxazole nucleus (e.g., oxazole, 4-methyloxazole, 5-methyloxazole, 4-phenyloxazole, 4,5-diphenyloxazole, 4-ethyloxazole, etc.), a benzoxazole nucleus (e.g., benzoxazole, 5-chlorobenzoxazole, 5-methylbenzoxazole, 5-bromobenzoxazole, 5-phenylbenzoxazole, 5-methoxybenzoxazole, 5-hydroxybenzoxazole, 5-carboxybenzoxazole, 6-methylbenzoxazole, 6-methoxybenzoxazole, 6-hydroxybenzoxazole, 5,6-dimethylbenzoxazole, 5-ethoxybenzoxazole, etc.), a naphthoxazole nucleus (e.g., naphtho[2,1-d]oxazole, naphtho[1,2-d]oxazole, naphtho[2,3-d]oxazole, etc.), an oxazoline nucleus (e.g., 4,4-dimethyloxazoline, etc.), a selenazole nucleus (e.g., 4-methylselenazole, 4-nitroselenazole, 4-phenylselenazole, etc.), a benzoselenazole nucleus (e.g., benzoselenazole, 5-chlorobenzoselenazole, 5-methoxybenzoselenazole, 5-hydroxybenzoselenazole, etc.), a naphthoselenazole nucleus (e.g., naphtho[2,1-d]selenazole, naphtho[1,2-d]selenazole, etc.), an imidazole nucleus (e.g., 1-alkylimidazole, 1-alkyl-4-phenylimidazole, 1-arylimidazole, etc.), a benzoimidazole nucleus (e.g., 1-alkylbenzoimidazole, 1-alkyl-5-chlorobenzoimidazole, 1-alkyl-5,6-dichlorobenzoimidazole, 1-alkyl-5-methoxybenzoimidazole, 1-alkyl-5-cyanobenzoimidazole, 1-alkyl-5-fluorobenzoimidazole, 1-alkyl-5-trifluoromethylbenzoimidazole, 1-alkyl-6-chloro-5-trifluoromethylbenzoimidazole, 1-alkyl-6-chloro-5-cyanobenzoimidazole, 1-arylbenzoimidazole, 1-aryl-5,6-dichlorobenzoimidazole, 1-aryl-6-dichlorobenzoimidazole, etc.), a naphthoimidazole nucleus (e.g., 1-alkylnaphtho[1,2-d]imidazole, etc.), a pyridine nucleus (e.g., 2-pyridine, 5-methyl-2-pyridine, etc.), a quinoline nucleus (e.g., 2-quinoline, 3-methyl-2-quinoline, 5-ethyl-2-quinoline, 6-methyl-2-quinoline, 8-fluoro-2-quinoline, etc.), and the like. The alkyl group which is present in the above-mentioned imidazole, benzoimidazole and naphthoimidazole may contain a carbon chain with hetero atoms such as O, N, S, etc., therein, and may be straight or branched chain. More preferably, suitable alkyl groups are those which contain 10 or less carbon atoms, which may contain atoms and substituents such as aryl, amino (primary, secondary, tertiary), alkoxy, alkenyl, aryloxy, hydroxy, alkoxycarbonyl, acyloxy, halogen, acyl, aminocarbonyl, cyano, etc. Specific examples of suitable alkyl groups include a methyl group, an ethyl group, a benzyl group, a phenethyl group, a dimethylaminopropyl group, a methoxyethyl group, a phenoxypropyl group, a methylsulfonylethyl group, a p-t-butylphenoxyethyl group, a cyclohexyl group, an octyl group, a decyl group, a carbamoylethyl group, an ethoxycarbonylethyl group a 2,2,2-trifluoroethyl group, a 2,2,3,3-tetrafluoropropyl group, a cyanopropyl group, an ethoxycarbonylmethyl group, a pivaloylpropyl group, a propionylethyl group, an acetoxyethyl group, a benzoyloxypropyl group, a chloroethyl group, a morpholinoethyl group, an acetylaminoethyl group, an allyl group, a 2-butenyl group, a 2-propynyl group, etc. The aryl group which is present in the above-mentioned imidazole, benzoimidazole, and naphthoimidazole can be a phenyl group, a halogen-(e.g., chloro)-substituted phenyl group, an alkyl-(e.g., methyl)-substituted phenyl group, an alkoxy-(e.g., methoxy)-substituted phenyl group, etc.

The alkyl group which may contain a substituent represented by $R_1$ may contain a carbon chain containing a hetero atom such as O, N, S, etc., therein, and may be straight or branched chain. More preferably, the alkyl group is one which contains 10 or less carbon atoms (including the carbon atoms of substituents present), which may contain a sulfo group, an aryl group, a carboxyl group, an amino (primary, secondary, tertiary) group, an alkoxy group, an alkenyl group, an aryloxy group, a hydroxy group, an alkoxycarbonyl group, an acyloxy group, a halogen atom, an acyl group, an aminocarbonyl group, a cyano group and the like.

For example, specific examples of alkyl groups for $R_1$ are a methyl group, an ethyl group, a sulfoethyl group, a sulfopropyl group, a sulfobutyl group, a benzyl group, a phenethyl group, a carboxyethyl group, a carboxymethyl group, a dimethylaminopropyl group, a methoxyethyl group, a phenoxypropyl group, a methylsulfonylethyl group, a p-t-butylphenoxyethyl group, a cyclohexyl group, an octyl group, a decyl group, a carbamoylethyl group, a sulfophenethyl group, a sulfobenzyl group, a 2-hydroxy-3-sulfopropyl group, an ethoxycarbonylethyl group, a 2,3-disulfopropoxypropyl group, a sulfopropoxyethoxyethyl group, a 2,2,2-trifluoroethyl group, a 2,2,3,3-tetrafluoropropyl group, a carboxybenzyl group, a cyanopropyl group, a p-carboxyphenethyl group, an ethoxycarbonylmethyl group, a pivaloylpropyl group, a propionylethyl group, an anisyl group, an acetoxyethyl group, a benzoyloxypropyl group, a chloroethyl group, a morpholinoethyl group, an acetylaminoethyl group, an N-ethylaminocarbonylpropyl group, an allyl group, a 2-butenyl group, a 2-propynyl group, a cyanoethyl group, and the like.

Suitable examples of aryl groups which may contain a substituent represented by $R_2$ include a phenyl group, a naphthyl group, a tolyl group, a carboxyphenyl group, a methoxycarbonylphenyl group, a chlorophenyl group, a xylyl group, a thienyl group, a furyl group, a pyridyl group, and the like.

The aralkyl group which may contain a substituent represented by $R_2$ is one which contains 7 to 14 carbon atoms (including carbon atoms of substituents present). Suitable examples of the aralkyl group include a benzyl group, an anisyl group, a phenylethyl group, and the like.

When $R_3$ combined with $R_1$ to form a ring, preferred rings are a 5-, 6-, or 7-membered ring.

Suitable lower alkyl groups which may contain a substituent represented by $R_4$ are preferably alkyl groups which contain 4 or less carbon atoms, which may be substituted with a phenyl group, a tolyl group, etc., or whose carbon chain may contain an oxygen atom. Specific examples of alkyl groups for $R_4$ include a methyl group, an ethyl group, a propyl group, a butyl group, a benzyl group, a phenethyl group, a methoxyethyl group, a tolylethyl group, and the like. Suitable aryl groups represented by $R_4$ are preferably aryl groups containing up to 2 aromatic fused nuclei. Specific examples of aryl groups include a phenyl group, a tolyl group and the like. Suitable aralkyl groups represented by $R_4$ preferably contain 7 to 14 carbon atoms. Specific examples of aralkyl group include a benzyl group, an anisyl group, a phenylethyl group, and the like.

Examples of acid anions represented by X include an acid anion which is used for conventional cyanine dye salts, such as an iodine ion, a bromine ion, a chlorine ion, a p-toluenesulfonate ion, a benzenesulfonate ion, a sulfate ion, a perchlorate ion, a rhodan ion, etc.

Compounds of the general formula (I) are more preferred in the present invention.

Of the compounds represented by the above-described general formula (I) and general formula (II) in the present invention, preferred examples of the compounds are those represented by the general formulae (III) and (IV), respectively.

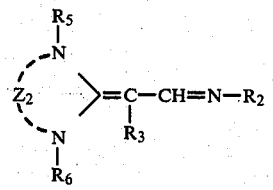
(III)

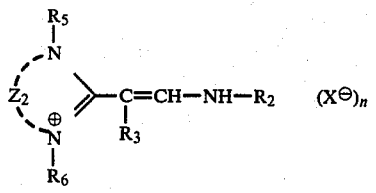
(IV)

wherein $Z_2$ represents the non-metal atoms necessary to complete an imidazole nucleus, a benzoimidazole nucleus or a naphthoimidazole nucleus, $R_5$ and $R_6$ each represents an unsubstituted or substituted alkyl group or an unsubstituted or substituted aryl group, which may be the same or different, $R_3$ represents a hydrogen atom or may form an alkylene group completing a ring on combining with $R_6$, and $R_2$, X and n are the same as described for $R_2$, X and n in the general formula (I) or (II).

The imidazole nucleus, benzoimidazole nucleus or naphthoimidazole nucleus which is completed by $Z_2$ is the same with the imidazole nucleus, benzoimidazole nucleus or naphthoimidazole nucleus defined in $Z_1$. $R_5$ and $R_6$, which may be the same or different, have the same meaning as $R_1$.

Compounds represented by the general formula (III) are particularly preferred.

Of the compounds represented by the above-described general formula (III) and general formula (IV) in the present invention, even more preferred examples of compounds are those represented by the general formulae (V) and (VI).

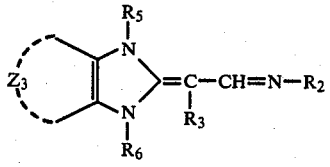
(V)

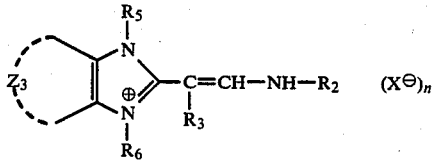
(VI)

wherein $Z_3$ represents the non-metal atoms to complete an unsubstituted or substituted benzene ring, and $R_2$, $R_3$, $R_5$, $R_6$, X and n each have the same meaning as $R_2$, $R_3$, $R_5$, $R_6$, X and n in the general formula (III) or (IV).

The benzoimidazole nucleus thus completed by $Z_3$ is the same as the benzoimidazole nucleus defined by $Z_1$. Above all, those compounds which contain a substituent such as a halogen atom (such as a chlorine atom, etc.), a fluoroalkyl (e.g., $CF_3$), a cyano group, etc., on the benzene ring are especially useful. Also, $R_5$ and $R_6$ which do not contain an acidic group (that is, where $R_5$ and $R_6$ are not an alkyl group substituted with a sulfo group or a carboxyl group, where they are an alkyl group, a halogenated alkyl group, etc.) are particularly useful.

The compound of the general formula (V) is preferably employed in the present invention.

Specific examples of compounds used in the present invention are illustrated below. The present invention, of course, is not to be construed as being limited to these compounds, however.

Specific examples of compounds represented by the general formula (I) include:

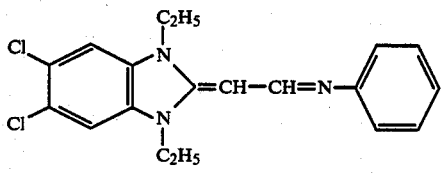
I-1

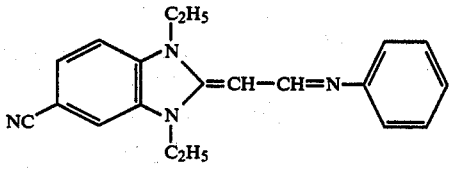
I-2

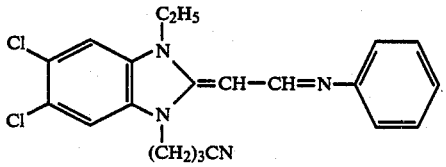
I-3

-continued
I-4
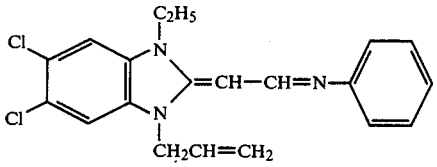
I-5
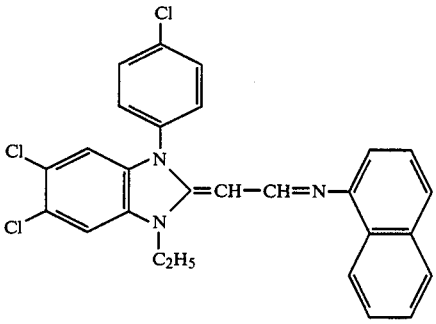
I-6
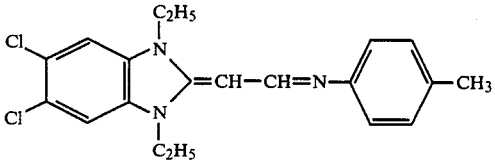
I-7
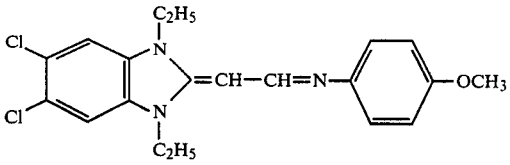
I-8
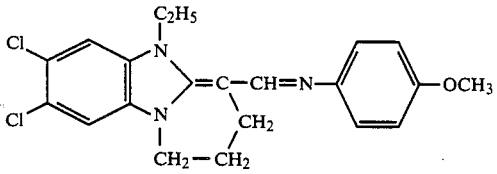
I-9
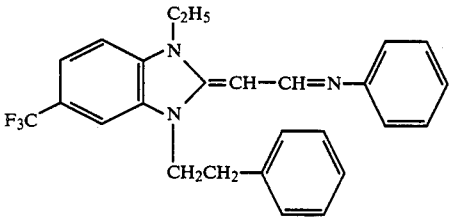
I-10
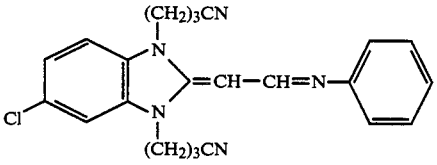
I-11
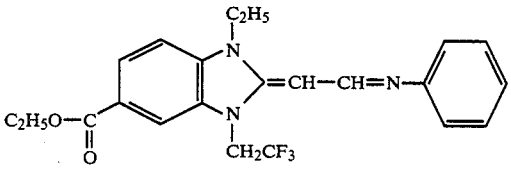
-continued
I-12
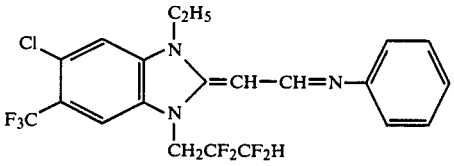
I-13
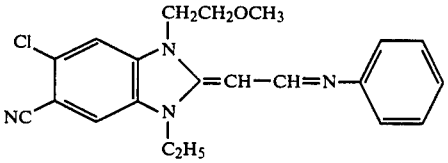
I-14
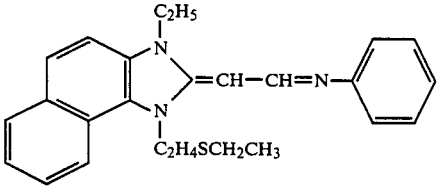
I-15
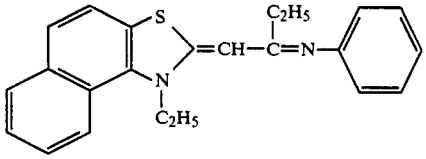
I-16
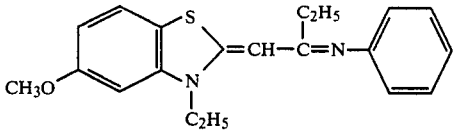
I-17
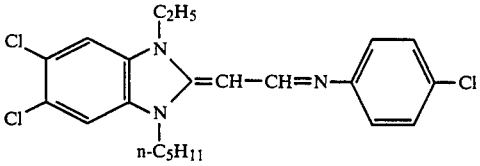
I-18
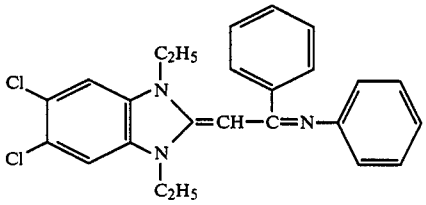
I-19
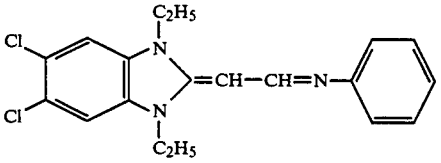
I-20
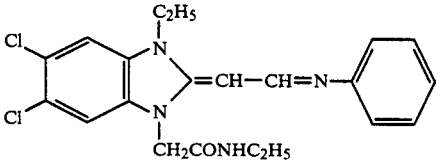

Specific examples of the compounds represented by the general formula (II) include:
II-1
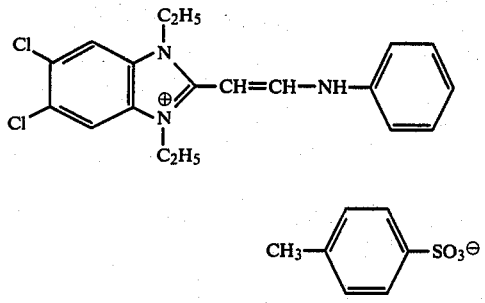
II-2
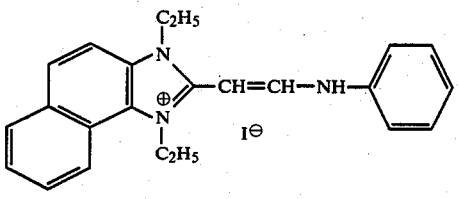
II-3
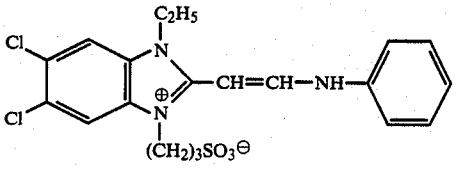
II-4
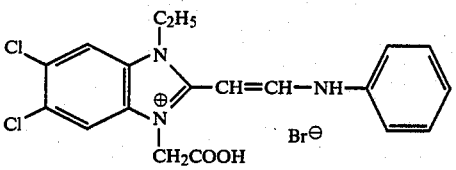
II-5
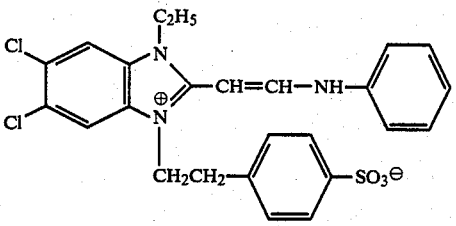
II-6
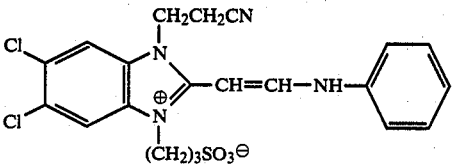
II-7
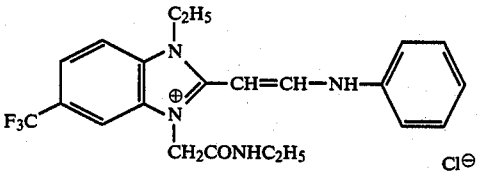
II-8
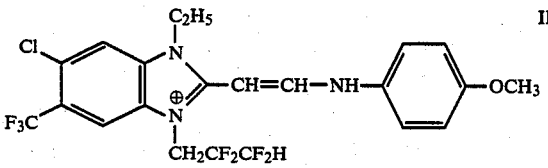
-continued
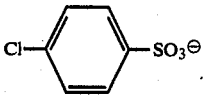
II-9
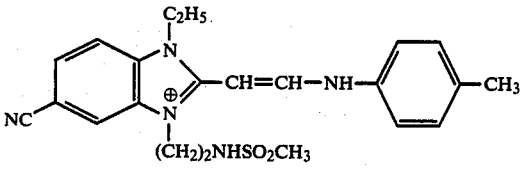
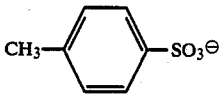
II-10
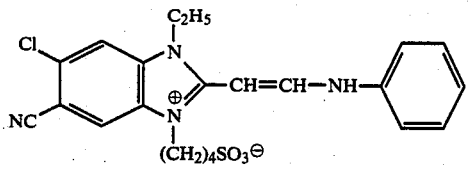
II-11
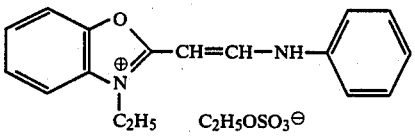
II-12
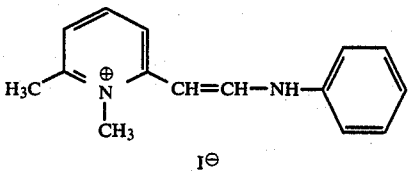
II-13
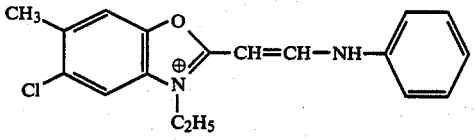
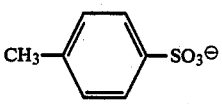
II-14
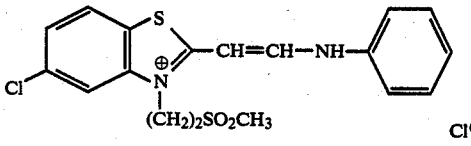
II-15
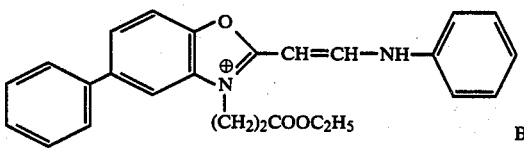

-continued

II-16

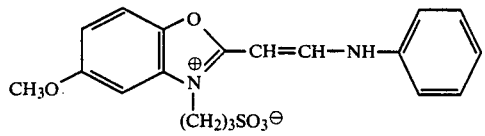

II-17

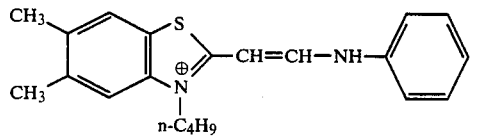

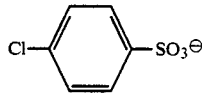

II-18

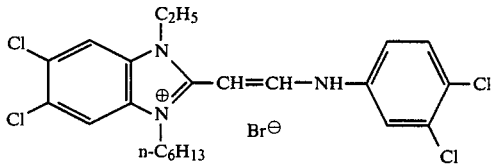

II-19

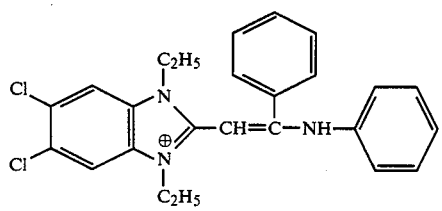

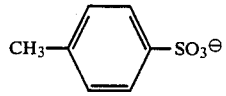

II-20

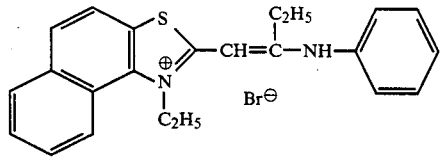

The compounds represented by the general formula (I) or (II) of the present invention are known compounds and can be easily synthesized by or based on the process described in U.S. Pat. No. 4,152,163.

The compounds represented by the general formula (I) or (II) can be employed in amounts of about 0.01 to about 10 mmols, preferably 0.05 to 2.0 mmols, per mol of silver halide in the silver halide emulsion layer containing tabular silver halide grains. The compounds can be added to the emulsion layer using conventional methods.

The compounds used in the present invention may be added thereto in any stage in the process of manufacturing silver halide photographic light-sensitive materials; for example, during production of a silver halide emulsion (e.g., during or after post ripening) or immediately before coating the emulsion.

Tabular silver halide grains used in the present invention are described below.

Tabular silver halide grains of the present invention have a diameter/thickness ratio of about 5:1 or more, preferably 5:1 to 100:1, more preferably 5:1 to 50:1, particularly preferably 7:1 to 20:1.

The term "diameter" in reference to silver halide grains means the diameter of a circle having an area equal to the projected area of the grains. Diameters of the tabular silver halide grains suitable for use in the present invention range from about 0.5 to about 10 μm, preferably 0.5 to 5.0 μm, more preferably 1.0 to 4.0 μm.

In general, tabular silver halide grains in a tabular form have two parallel planes. Therefore, in the present invention, the term "thickness" in relation to the silver halide grains means the distance between the two parallel planes constituting the tabular silver halide grains.

Silver bromide and silver bromoiodide are preferred silver halide compositions for tabular silver halide grains with silver bromoiodide containing 0 to 10 mol% silver iodide being particularly preferred.

Processes for preparing tabular silver halide grains which can be used in the present invention are described below.

Tabular silver halide grains which can be used can be prepared using processes known to those skilled in the art.

For example, tabular silver halide grains can be obtained by forming seed crystals containing 40% by weight or more tabular grains in an environment of a comparatively low pBr value of about 1.3 or less in pBr, then simultaneously adding thereto a silver salt solution and a halide solution while maintaining the pBr at about the same level to thereby allow the seed crystals to grow.

During the growth of the grains, addition of the silver salt solution and the halide solution are desirable so as not to form new crystal nuclei.

The size of tabular silver halide grains can be appropriately adjusted by adjusting temperature, selecting the proper kind and amount of solvent, and controlling the speed of adding the silver salt and the halide during growth of the grains.

A silver halide solvent may be used, if desired, for controlling grain size, form of the grains (e.g., diameter-to-thickness ratio), particle size distribution of the grains, and the grain-growth rate in the production of the tabular silver halide grains used in the present invention. Such a silver halide solvent is used in an amount of about $10^{-3}$ to about 1.0 wt%, particularly $10^{-2}$ to $10^{-1}$ wt%, based on the weight of the reaction solution.

For example, particle size distribution can be made monodispersed and the grain growth rate can be accelerated by increasing the amount of the solvent used. On the other hand, the use of an increased amount of the solvent tends to increase the thickness of the resulting grains.

Silver halide solvents often used include ammonia, thioethers, thioureas, etc. Suitable thioethers are disclosed in U.S. Pat. Nos. 3,271,157, 3,790,387, 3,574,628, etc.

Upon production of the tabular silver halide grains of the present invention, the silver salt solution (for example, a silver nitrate aqueous solution) and the halide solution (for example, a potassium bromide aqueous solution) are added preferably in such a manner that the addition rate, amounts added and concentration added are increased to accelerate the particle growth.

Processes for producing silver halide grains are described in British Pat. No. 1,335,925, U.S. Pat. Nos. 3,672,900, 3,650,757 and 4,242,445, and Japanese Patent Application (OPI) Nos. 142329/80 and 158124/80, etc.

The tabular silver halide grains used in the present invention can be chemically sensitized as the occasion demands.

Suitable chemical sensitizing methods include gold sensitization using a so-called gold compound (e.g., as disclosed in U.S. Pat. Nos. 2,448,060 and 3,320,069, etc.), metal sensitization methods include use of iridium, platinum, rhodium, palladium, etc. (e.g., as disclosed in U.S. Pat. Nos. 2,448,060, 2,566,245 and 2,566,263, etc.), sulfur sensitization methods include use of a sulfur-containing compound (e.g., as disclosed in U.S. Pat. No. 2,222,264, etc.), and reduction sensitization methods include use of a tin salt or a polyamine (e.g., as disclosed in U.S. Pat. Nos. 2,487,850, 2,518,698 and 2,521,925, etc.). These methods can be employed alone or in a combination of two or more of them may be used.

With respect to conserving silver, the tabular silver halide grains used in the present invention are preferably subjected to gold sensitization, sulfur sensitization or a combination thereof.

A layer containing the tabular silver halide grains used in the present invention preferably contains about 40% by weight or more, particularly preferably 60% by weight or more, of the tabular grains based on the total amount of silver halide grains.

The layer containing the tabular silver halide grains preferably has a thickness of about 0.3 to about 5.0$\mu$, particularly preferably 0.5 to 3.0$\mu$.

The tabular silver halide grains are preferably coated in an amount of about 0.5 to about 6 g/m$^2$, particularly preferably 1 to 4 g/m$^2$ (per side of a support).

Other constituents of the layer containing the tabular silver halide grains used in the present invention, such as a binder, a hardener, an antifoggant, a silver halide-stabilizing agent, a surfactant, an optically sensitizing agent, a dye, an ultraviolet ray absorbent, a chemically sensitizing agent, plasticizer, etc., are not particularly limited, and reference can be made to, for example, *Research Disclosure,* Vol. 176, pp. 22 to 28 (December, 1978).

Ordinary silver halide grains may be incorporated in the emulsion layer of the silver halide light-sensitive material of the present invention in addition to the tabular silver halide grains. Such grains can be prepared by processes described in P. Glafkides, *Chimie et Physique Photographique* (published by Paul Montel in 1967), G. F. Duffin, *Photographic Emulsion Chemistry,* (The Focal Press, 1966), and V. L. Zelikman et al., *Making and Coating Photographic Emulsion* (The Focal Press, 1964), that is, by any of an acidic process, a neutral process, an ammoniacal process, etc. Any of one side mixing, simultaneous mixing, and their combination may be employed to react a soluble silver salt with a soluble halide salt.

A process for forming grains in the presence of excess silver ion (the so-called reverse mixing process) can be employed as well. A process called the controlled double jet process wherein the pAg in the liquid phase in which silver halide is formed is kept constant can be employed as one type of simultaneous mixing process.

Any of silver bromide, silver bromoiodide, silver chlorobromoiodide, silver chlorobromide, and silver chloride may be used as the silver halide in these ordinary silver halide grains.

During formation or physical ripening of the silver halide grains, cadium salts, zinc salts, lead salts, thallium salts, iridium salts or the complex salts thereof, rhodium salts or the complex salts thereof, iron salts or the complex salts thereof, etc., may be present. If desired, the grains may be chemically sensitized in the same manner as the tabular silver halide grains.

Various compounds may be present in the photographic emulsion to be used in the present invention for preventing fogging of the light-sensitive materials during their production, storage or photographic processing or for stabilizing the photographic properties of the materials. That is, known antifoggants or stabilizers can be employed, for example, azoles (e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly, 1-phenyl-5-mercaptotetrazole), etc.); mercaptopyrimidines; mercaptotriazines; thioketo compounds such as oxazolinethione; azaindenes (e.g., triazaindenes, tetraazaindenes (particularly, 4-hydroxy-substituted (1,3,3a,7)tetraazaindenes), pentaazaindenes, etc.); benzenethiosulfonic acid; benzenesulfinic acid; benzenesulfonic acid amide; etc. For example, those described in U.S. Pat. Nos. 3,954,474 and 3,982,947, and Japanese Patent Publication No. 28660/77 can be used.

The photographic emulsion to be used in the present invention may be spectrally sensitized with methine dyes or the like.

Useful sensitizing dyes are those described in, for example, German Pat. No. 929,080, U.S. Pat. Nos. 2,493,748, 2,503,776, 2,519,001, 2,912,329, 3,656,959, 3,672,897, 3,694,217, 4,025,349 and 4,046,572, British Pat. No. 1,242,588 and Japanese Patent Publication Nos. 14030/69 and 24844/77.

These sensitizing dyes may be used alone or in combination. Combinations of sensitizing dyes are often employed particularly for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,814,609, 3,837,862 and 4,026,707, British Pat. Nos. 1,344,281 and 1,507,803, Japanese Patent Publication Nos. 4936/68, 12375/78 and Japanese Patent Application (OPI) Nos. 110618/77 and 109925/77.

A dye which itself is not spectrally sensitizing or a substance which substantially does not absorb visible light and which exhibits a supersensitizing effect may be incorporated together with the sensitizing dye. For example, aminostilbene compounds substituted by a nitrogen-containing hetero ring group (e.g., those described in U.S. Pat. Nos. 2,933,390 and 3,635,721), aromatic organic acid-formaldehyde condensates (for example, those described in U.S. Pat. No. 3,743,510), cadmium salts, azaindene compounds, etc., may be employed. Combinations described in U.S. Pat. Nos. 3,615,613, 3,615,641, 3,617,295, and 3,635,721 are particularly useful.

The photographic light-sensitive material of the present invention can contain in the photographic emulsion layers color-forming couplers capable of forming color by oxidative coupling with an aromatic primary amine developing agent (for example, a phenylenediamine derivative or an aminophenol derivative) on color development processing. For example, suitable magenta couplers include 5-pyrazolone couplers, pyrazolobenzimidazole couplers, cyanoacetylcoumarone couplers, open-chain acylacetonitrile couplers, etc., exemplary yellow couplers include acylacetamide couplers (e.g., benzoylacetanilide couplers, pivaloylacetanilide couplers, etc.), and suitable cyan couplers include naphthol couplers and phenol couplers. Of these couplers, non-diffusible couplers having a hydrophobic group as a ballast group are desirable. The couplers may be either the 4-equivalent type or the 2-equivalent type with respect to silver ion. Colored couplers providing a color-correcting effect or couplers capable of releasing a development inhibitor upon development (the so-called DIR couplers) may also be used.

In addition to DIR couplers, DIR coupling compounds capable of forming a colorless coupling reaction product and releasing a development inhibitor may also be employed.

Other constitutions of the emulsion layer of the silver halide photographic light-sensitive material in accordance with the present invention are not particularly limited, and various additives may be used as the occasion demands. For example, binders, surfactants, ultraviolet absorbents, hardeners, coating aids, thickening agents, etc., e.g., as described in *Research Disclosure,* 176, pp. 22–28 (December, 1978) may be used.

The photographic material of the present invention preferably has on its surface a surface-protecting layer containing as a major component a synthetic or natural high polymer substance such as gelatin, a water-soluble polyvinyl compound or an acrylamide polymer (see, for example, U.S. Pat. Nos. 3,142,568, 3,193,386, and 3,062,674).

The surface-protecting layer may contain, in addition to gelatin or other high molecular weight substance, a surfactant, an antistatic agent, a matting agent, a slipping agent, a hardener, a thickening agent, etc.

The photographic material of the present invention may also include an interlayer, a filter layer, an antihalation layer, etc.

The photographic emulsion layers and other layers of the photographic light-sensitive material of the present invention can be coated on a flexible support such as a synthetic resin film, paper or cloth or on a rigid support such as glass, porcelain or metal, conventionally used for photographic light-sensitive materials. Useful flexible supports include films of semi-synthetic or synthetic high polymers such as cellulose nitrate, cellulose acetate, cellulose acetate butyrate, polystyrene, polyvinyl chloride, polyethylene terephthalate, polycarbonate, etc., and papers coated or laminated with a baryta layer or an $\alpha$-olefin polymer (for example, polyethylene, polypropylene, ethylene/butene copolymer, etc.). The support may be colored with a dye or a pigment, or may be blackened for intercepting light. The surface of the support is generally subbed for improving adhesion to a photographic emulsion layer or the like. The support surface may be subjected to corona discharge treatment, UV light irradiation, or flame treatment before or after the subbing treatment.

In the present invention, processes for coating a tabular silver halide grain-containing layer, an emulsion layer, and a surface-protecting layer on a support are not particularly limited, and processes of simultaneously coating multilayers described in, for example, U.S. Pat. Nos. 2,761,418, 3,508,947, 2,761,791, etc., can be advantageously used.

Various structures are possible for the stratum structure of the photographic material of the present invention. For example, (1) a stratum structure wherein a layer containing tabular silver halide grains in accordance with the present invention is provided on a support, a silver halide emulsion layer containing high speed silver halide grains of a comparatively large particle size (0.5 to 3.0$\mu$) with a spherical form or having a diameter-to-thickness ratio of less than 3 is provided thereon, and a surface-protecting layer of gelatin or the like is further coated on the silver halide emulsion layer; (2) a stratum structure wherein a tabular silver halide grain-containing layer is provided on a support, a plurality of silver halide emulsion layers are provided thereon, and a surface-protecting gelatin layer is further provided thereon; (3) a stratum structure wherein one silver halide emulsion layer is provided on a support, a tabular silver halide grain-containing layer is provided thereon, a high-speed silver halide emulsion layer is provided thereon, and a surface-protecting gelatin layer on the high-speed silver halide emulsion layer; (4) a stratum structure wherein a layer containing an ultraviolet ray absorbent or a dye, a tabular silver halide grain-containing layer, a silver halide emulsion layer, and a surface-protecting gelatin layer are provided in this order on a support; and (5) a stratum structure wherein a layer containing tabular silver halide grains and an ultraviolet ray absorbent or a dye, a silver halide emulsion layer, and a surface-protecting gelatin layer are provided in this order on a support, can be used. In these embodiments, the silver halide emulsion layer is not necessarily a single layer and may be composed of a plurality of silver halide emulsion layers spectrally sensitized to different wavelength regions, if desired.

Also, the layer containing tabular silver halide grains and the silver halide emulsion layer may be coated on both sides of the support, if desired.

The silver halide photographic light-sensitive material of the present invention specifically is applicable to color photographic light-sensitive materials such as color negative films, color reversal films, color papers, etc., as well as black-and-white photographic light-sensitive materials such as X-ray light-sensitive materials (for indirect X-ray or direct X-ray irradiation), lithographic light-sensitive materials, black-and-white photographic printing papers, black-and-white negative films, etc. X-ray light-sensitive materials which are to be subjected to high-temperature, accelerated development processing provide the most remarkable effects.

Any known processes and known processing solutions described in, for example, *Research Disclosure,* No. 176, pages 28–30 (RD-17643) may be employed for the photographic processing of the light-sensitive materials of the present invention. This processing can be a black-and-white photographic processing for forming a silver image or a color photographic processing for forming a dye image depending upon the purpose. The processing temperature is usually between about 18 to about 50° C. However, temperatures lower than about 18° C. or higher than about 50° C. may be employed.

The developing solution for conducting black-and-white photographic processing can contain known developing agents. Suitable developing agents include dihydroxybenzenes (e.g., hydroquinone), 3-pyrazolidones (e.g., 1-phenyl-3-pyrazolidone), aminophenols (e.g., N-methyl-p-aminophenol), etc., which can be used alone or in combination. Generally, the developing solution further contains known preservatives, alkali agents, pH buffers, antifogging agents, etc., and, if desired, may further contain dissolving aids, toning agents, development accelerators (e.g., quaternary salts, hydrazine, benzyl alcohol, etc.), surfactants, defoaming agents, water-softening agents, hardeners (e.g., glutaraldehyde), viscosity-imparting agents, etc.

The so-called "lith-type" development processing may be applied to the photographic emulsion of the present invention. "Lith-type" development processing means a development processing using generally a dihydroxybenzene as a developing agent and conducting development in an infectious manner at a low sulfite ion concentration for photographically reproducing line images or halftone dot images. (Detailed descriptions are given in L. F. A. Mason, *Photographic Processing Chemistry,* (Focal Press, 1966), pp. 163–165.

A developing agent may be incorporated in a light-sensitive material, for example, in an emulsion layer and the resulting light-sensitive material is processed in an alkaline aqueous solution for development as a special type of development processing. Hydrophobic developing agents can be incorporated in an emulsion using the various techniques described in *Research Disclosure,* No. 169 (RD-16928), U.S. Pat. No. 2,739,890, British Pat. No. 813,253 and West German Pat. No. 1,547,763, etc. Such development processing may be combined with a processing for stabilizing silver salt with a thiocyanate, if desired.

Suitable fixing solutions are those which have the same formulation as are ordinarily employed. Organic sulfur compounds can be used as fixing agents as well as thiosulfates and thiocyanates. The fixing solution may also contain an aqueous aluminum salt as a hardener.

Conventional processes can be employed in forming dye images. For example, suitable processes which may be employed include a negative-positive process (described in, for example, *Journal of the Society of Motion Picture and Television Engineers,* Vol. 61, pp. 667–701 (1953); a color reversal process of forming a negative silver image by developing with a developing solution containing a black-and-white developing agent, conducting at least once uniform exposure or other proper fogging processing, and subsequently conducting color development to thereby obtain positive dye images; a silver dye-bleaching process of developing a silver image by developing a dye-containing photographic emulsion layer after imagewise exposure to thereby form a silver image, and bleaching the dye using the silver image as a bleaching catalyst.

A color developing solution generally comprises an alkaline aqueous solution containing a color-developing agent. Suitable color-developing agents include known primary aromatic amine developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfamidoethylaniline, 4-amino-3-methyl-N-ethyl-N-β-methoxyethylaniline, etc.).

In addition, those described in L. F. A. Mason, *Photographic Processing Chemistry,* (Focal Press, 1966), pp. 226–229, U.S. Pat. Nos. 2,193,015 and 2,592,364 and Japanese Patent Application (OPI) No. 64933/73, etc., can be used.

A pH buffer, a development restrainer, an antifogging agent, a water softener, a preservative, an orgaic solvent, a development accelerating agent, a carboxylic acid type chelating agent, etc., may further be added to the color developing solution, if desired.

Specific examples of these additives are described in *Research Disclosure* (Rd-17643), U.S. Pat. No. 4,083,723 and West German Patent Application (OLS) No. 2,622,950, etc.

The present invention remarkably reduces fluctuation in photographic properties caused by change in development processing conditions, without concurrent reduction in sensitivity, by adding a compound represented by the general formula (I) or (II) to a silver halide emulsion layer containing the above-described tabular silver halide grains. This effect is conspicuous with high-temperature, accelerated processing (for example, at about 28° C. to 40° C. for 30 seconds or shorter). In particular, the present invention is effective for high-temperature, accelerated processing conducted by adding an aldehyde type hardener (glutaraldehyde or the like) to a developing solution.

The present invention will now be described in more detail by reference to following non-limiting examples of preferred embodiments of the present invention. Unless otherwise indicated, all parts, percents, ratios and the like are by weight.

EXAMPLE 1

Photographic Material (1) was prepared as follows.

To 1 l of water were added 30 g of gelatin, 10.3 g of potassium bromide and 10 cc of a 0.5 wt% thioether [$HO(CH_2)_3—S—(CH_2)_2—S—(CH_2)_2OH$] aqueous solution and the resulting solution was kept in a container at 75° C. (pAg 9.1, pH 6.5). To the container, Solutions (I) and (II) described below were simultaneously added with stirring within a 30 second period, followed by simultaneously adding thereto Solutions (III) and (IV) within a 65 minute period using a double jet method.

In addition, during the addition of Solutions (III) and (IV), Solution (V) was simultaneously added thereto within a 15 minute period, followed by post-ripening together with gold and sulfur sensitizations.

| | Solution (I) | Solution (II) | Solution (III) | Solution (IV) | Solution (V) |
|---|---|---|---|---|---|
| $AgNO_3$ (g) | 5 | — | 95 | — | — |
| $H_2O$ (cc) | 30 | 16.7 | 568 | 542 | 100 |
| KBr (g) | — | 3.15 | — | 69.6 | — |
| KI (g) | — | — | — | — | 1.5 |
| $HO(CH_2)_2S(CH_2)_2S(CH_2)_2OH$ 5 wt % aqueous solution (cc) | — | 0.45 | — | 15.0 | — |

The tabular silver halide grains thus obtained had a mean diameter of 2.0μ and an average diameter/thickness ratio of 14:1 and contained 1.5 mol% of silver iodide. Then, an antifogging agent (1-phenyl-5-mercaptotetrazole), a stabilizer (4-hydroxy-6-methyl-1,3,3a,7-tetraazaindene), a coating aid (dodecylbenzenesulfonate), and a thickening agent (polypotassium-p-vinylbenzenesulfonate) were added thereto to prepare a coating solution. This solution had a silver/gelatin ratio of 0.96:1 by weight.

Then, a 10 wt% gelatin aqueous solution containing gelatin, sodium polystyrenesulfonate, polymethyl methacrylate fine particles (mean particle size: 3.0μ), saponin, and 2,4-dichloro-6-hydroxy-s-triazine was prepared as a coating solution for forming a surface protecting layer.

Next, on a polyethylene terephthalate film support was coated, in sequence, a silver halide emulsion layer composed of the above-described coating solution and a surface-protecting layer composed of the above-described coating solution, then dried to prepare Photographic Material (1). In this occasion, the silver halide emulsion layer was coated in a silver amount of 2.8 g/m$^2$, and the surface-protecting layer in a gelatin amount of 1.3 g/m$^2$.

Photographic Materials (2) to (15) were prepared using the Compounds shown in Table 1 below and Comparative Compounds VII-1 to VII-8, respectively, shown below to the coating solution used for the above-described Photographic Material (1).

Each of the Photographic Materials (1) to (15) thus obtained was exposed using X-rays using a screen containing calcium tungstate ($CaWO_4$) as a phosphor, then developed with the following Processing Solution A at 35° C. and 38° C. for 25 seconds, fixed with Fixing Solution B at 35° C. for 25 seconds followed by washing.

| | |
|---|---|
| Developing Solution A | |
| 1-Phenyl-3-pyrazolidone | 1.5 g |
| Hydroquinone | 30 g |
| 5-Nitroindazole | 0.25 g |
| Potassium Bromide | 6.0 g |
| Sodium Sulfite (anhydrous) | 50 g |
| Potassium Hydroxide | 30 g |
| Boric Acid | 10 g |
| Glutaraldehyde | 5 g |
| Water added to make the total amount 1 l | |
| (pH: adjusted to 10.20) | |
| Fixing Solution B | |
| Ammonium Thiosulfate | 200.0 g |
| Sodium Sulfite (anhydrous) | 20.0 g |
| Boric Acid | 8.0 g |
| Disodium Ethylenediaminetetraacetate | 0.1 g |
| Aluminum Sulfate | 15.0 g |
| Sulfuric Acid | 2.0 g |
| Glacial Acetic Acid | 22.0 g |
| Water to make | 1.0 l |
| (pH: adjusted to 4.20) | |

The sensitivity of each of the thus-processed photographic materials was measured and the results obtained are given in Tables 1 and 2 below. In Table 1, sensitivity is presented as the logarithm of the reciprocal of amount of exposure necessary to obtain a photographic density of 0.5 above fog. The fog value was taken the net value above basic density.

Comparative Compounds used in the examples herein had the following formulas:

VII-1

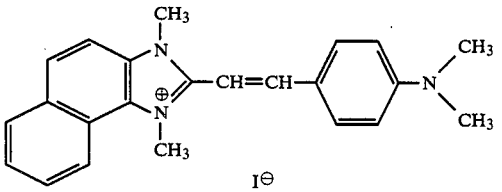

VII-2

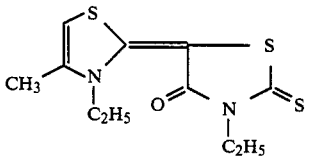

-continued

VII-3

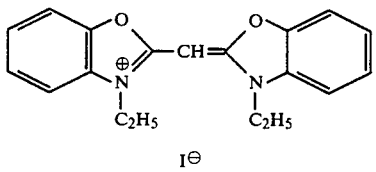

VII-4

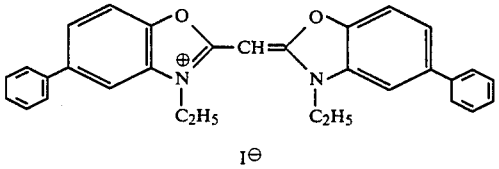

VII-5

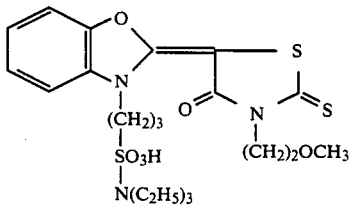

VII-6

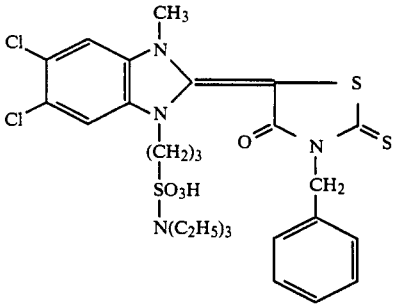

VII-7

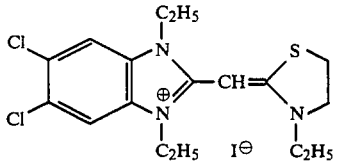

VII-8

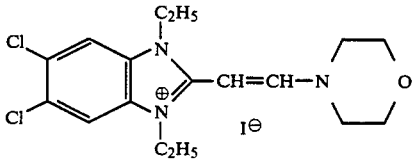

TABLE 1

Results of Development by Developing Solution A at 35° C. for 25 Sec.

| Photographic Material | Dye Added | Addition Amount (mmol/mol Ag) | Fog | Sensitivity (log E) |
|---|---|---|---|---|
| 1 | None | — | 0.07 | 0 |
| | Invention Dye | | | |
| 2 | I-1 | 0.634 | 0.04 | +0.09 |
| 3 | II-1 | " | 0.03 | +0.10 |
| 4 | I-14 | " | 0.06 | +0.06 |
| 5 | II-2 | " | 0.05 | +0.06 |
| 6 | I-16 | " | 0.07 | +0.04 |
| 7 | II-11 | " | 0.07 | +0.05 |
| | Comparative Dye | | | |
| 8 | VII-1 | 0.634 | 0.09 | −0.01 |
| 9 | VII-2 | " | 0.08 | −0.06 |

TABLE 1-continued

| Photographic Material | Dye Added | Addition Amount (mmol/mol Ag) | Fog | Sensitivity (log E) |
|---|---|---|---|---|
| | Results of Development by Developing Solution A at 35° C. for 25 Sec. | | | |
| 10 | VII-3 | " | 0.08 | 0 |
| 11 | VII-4 | " | 0.07 | −0.19 |
| 12 | VII-5 | " | 0.07 | −0.12 |
| 13 | VII-6 | " | 0.08 | −0.01 |
| 14 | VII-7 | " | 0.07 | −0.01 |
| 15 | VII-8 | " | 0.08 | −0.02 |

TABLE 2

| Photographic Material | Dye Added | Fog |
|---|---|---|
| | Results of Development with Developing Solution A at 38° C. for 25 Sec. | |
| 1 | None | 0.11 |
| | Invention Dye | |
| 2 | I-1 | 0.05 |
| 3 | II-1 | 0.04 |
| 4 | I-14 | 0.07 |
| 5 | II-2 | 0.06 |
| 6 | I-16 | 0.08 |
| 7 | II-11 | 0.08 |
| | Comparative Dye | |
| 8 | VII-1 | 0.21 |
| 9 | VII-2 | 0.10 |
| 10 | VII-3 | 0.12 |
| 11 | VII-4 | 0.09 |
| 12 | VII-5 | 0.09 |
| 13 | VII-6 | 0.10 |
| 14 | VII-7 | 0.12 |
| 15 | VII-8 | 0.12 |

As is clear from the results in Table 1 and Table 2 above, the compounds of the present invention remarkably effectively depress fog during high-temperature accelerated processing and also show a marked increase in sensitivity.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material which comprises a support, a hydrophilic colloid layer or layers and a silver halide emulsion layer or layers, wherein at least one of said silver halide emulsion layers contains tabular silver halide grains having a diameter:thickness ratio of 5:1 or more and at least one compound represented by the following general formula (I) or general formula (II)

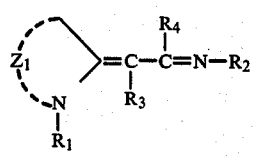

(I)

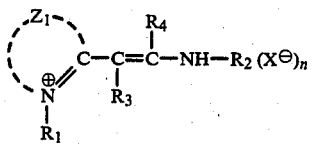

(II)

wherein $Z_1$ represents the non-metal atoms necessary to complete a 5- or 6-membered heterocyclic ring; $R_1$ represents an unsubstituted or substituted alkyl group; $R_2$ represents an unsubstituted or substituted aryl group with up to 2 aromatic fused rings, or an unsubstituted or substituted aralkyl group; $R_3$ represents a hydrogen atom or with $R_1$ an alkylene group forming a ring; $R_4$ represents a hydrogen atom, an unsubstituted or substituted lower alkyl group or an unsubstituted or substituted aryl group, or an unsubstituted or substituted aralkyl group; n represents 0 or 1, with n being 0 when an inner salt is formed; and X represents an acid anion.

2. The silver halide photographic light-sensitive material of claim 1, wherein said compound represented by the general formula (I) or (II) is a compound represented by the following general formula (III) or (IV):

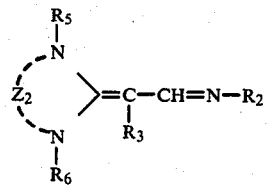

(III)

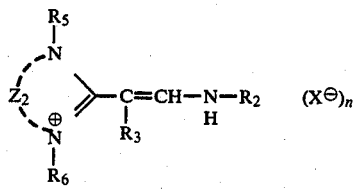

(IV)

wherein $Z_2$ represents the non-metal atoms necessary to complete an imidazole nucleus, a benzoimidazole nucleus or a naphthoimidazole nucleus; $R_5$ and $R_6$ each represents an unsubstituted or substituted alkyl group or an unsubstituted or substituted aryl group, which may be the same or different; $R_3$ represents a hydrogen atom or with $R_6$ an alkylene group forming a ring; and $R_2$, X and n have the same meaning as $R_2$, X and n in the general formula (I) or (II) of claim 1.

3. The silver halide photographic light-sensitive material of claim 2, wherein the compound represented by the general formula (III) or (IV) is a compound represented by the following general formula (V) or (VI):

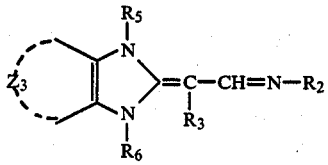

(V)

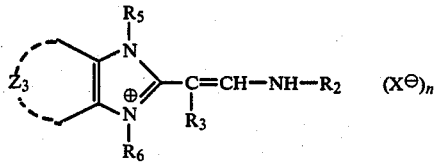

(VI)

wherein $Z_3$ represents the non-metal atoms to complete an unsubstituted or substituted benzene ring, and $R_2$, $R_3$, $R_5$, $R_6$, X and n each have the same meaning as $R_2$, $R_3$, $R_5$, $R_6$, X and n in the general formula (III) or (IV) of claim 2.

4. The silver halide photographic light-sensitive material of claim 1, wherein the heterocyclic ring completed by $Z_1$ is a thiazole nucleus, a benzothiazole nucleus, a naphthothiazole nucleus, a thiazoline nucleus, an oxazole nucleus, a benzoxazole nucleus, a naphthoxazole nucleus, an oxazoline nucleus, a selenazole nucleus, a benzoselenazole nucleus, a naphthoselenazole nucleus, an imidazole nucleus, a benzoimidazole nucleus, a naphthoimidazole nucleus, a pyridine nucleus, or a quinoline nucleus; the alkyl group for $R_1$ may be a straight or branched chain alkyl group having one or more oxygen atoms, nitrogen atoms and sulfur atoms in the chain thereof, and may contain one or more of a sulfo group, an aryl group, a carboxyl group, an amino group, an alkoxy group, an alkenyl group, an aryloxy group, a hydroxy group, an alkoxycarbonyl group, an acyloxy group, a halogen atom, an acyl group, an aminocarbonyl group or a cyano group as substituents; the aryl group represented by $R_2$ is a phenyl group, a naphthyl group, a tolyl group, a carboxyphenyl group, a methoxycarbonylphenyl group, a chlorophenyl group, a xylyl group, a thienyl group, a furyl group, or a pyridyl group; the aralkyl group for $R_2$ is a benzyl group, an anisyl group or a phenylethyl group; the combination of $R_3$ and $R_1$ forms a 5-, 6-, or 7-membered ring; the lower alkyl group for $R_4$ is an alkyl group containing 4 or less carbon atoms, which may be substituted with a phenyl group or a tolyl group and wherein an oxygen atom may be present in the alkyl chain; the aryl group for $R_4$ is a phenyl group or a tolyl group; the aralkyl group for $R_4$ is a benzyl group, an anisyl group or a phenylethyl group; and X is an iodine ion, a bromine ion, a chlorine ion, a p-toluenesulfonate ion, a benzenesulfonate ion, a sulfate ion, a perchlorate ion, or a rhodan ion.

5. The silver halide photographic light-sensitive material of claim 1, wherein said compounds represented by the general formula (I) or the general formula (II) is present in an amount of about 0.01 to about 10 millimoles, per mole of silver halide in the silver halide emulsion layer containing tabular silver halide grains.

6. The silver halide photographic light-sensitive material of claim 1, wherein said tabular silver halide grains have a diameter:thickness ratio of 5:1 to 100:1.

7. The silver halide photographic light-sensitive material of claim 1, wherein the diameter of the tabular silver halide grains ranges from about 0.5 to 10 micrometers.

8. The silver halide photographic light-sensitive material of claim 1, wherein the material contains at least one compound represented by the general formula I.

9. The silver halide photographic light-sensitive material of claim 2, wherein the material contains at least one compound represented by the general formula I.

10. The silver halide photographic light-sensitive material of claim 3, wherein the material contains at least one compound represented by the general formula I.

11. The silver halide photographic light-sensitive material of claim 4, wherein the material contains at least one compound represented by the general formula I.

12. The silver halide photographic light-sensitive material of claim 5, wherein the material contains at least one compound represented by the general formula I.

13. The silver halide photographic light-sensitive material of claim 6, wherein the material contains at least one compound represented by the general formula I.

14. The silver halide photographic light-sensitive material of claim 7, wherein the material contains at least one compound represented by the general formula I.

15. The silver halide photographic light-sensitive material of claim 1, wherein the compound represented by formulae I or II is present in an amount sufficient to effectively depress fog during high-temperature accelerated processing.

* * * * *